US009936753B2

(12) United States Patent
Yeh

(10) Patent No.: US 9,936,753 B2
(45) Date of Patent: Apr. 10, 2018

(54) DECORATIVE MASK

(71) Applicant: Chia-Ching Yeh, Taipei (TW)

(72) Inventor: Chia-Ching Yeh, Taipei (TW)

( * ) Notice: Subject to any disclaimer, the term of this patent is extended or adjusted under 35 U.S.C. 154(b) by 241 days.

(21) Appl. No.: 14/826,221

(22) Filed: Aug. 14, 2015

(65) Prior Publication Data

US 2017/0042266 A1 Feb. 16, 2017

(51) Int. Cl.
*A41G 7/00* (2006.01)

(52) U.S. Cl.
CPC ..... *A41G 7/00* (2013.01)

(58) Field of Classification Search
CPC ..... A42B 1/004; A42B 1/006
USPC ..... 2/174, DIG. 11; 446/27
See application file for complete search history.

(56) References Cited

U.S. PATENT DOCUMENTS 1,485,160 A * 2/1924 Bassan ..... A61F 9/02 128/201.24
5,826,597 A * 10/1998 Chou ..... A45D 8/36 132/273
6,047,709 A * 4/2000 Tu ..... A45D 8/00 132/273
6,505,351 B2 * 1/2003 Yeh ..... A41G 7/00 2/206
6,604,975 B1 * 8/2003 Yeh ..... A41G 7/02 2/206
6,842,911 B2 * 1/2005 Yeh ..... A42B 1/004 2/171.02
8,758,074 B2 * 6/2014 Dilworth ..... A63H 37/00 446/26

* cited by examiner

*Primary Examiner* — Sarah B McPartlin

(57) ABSTRACT

A decorative mask is used as face covering in masquerade, comprising an inverted U-shaped headband with resilient and holding function configured to wear around a user's head; a covering piece positioned on and connected with the headband by a connector; said covering piece defined as a mask; the connector including a first end arranged in one end thereof and connected in a center of a bottom end of the headband; a second end arranged in the other end thereof and connected in a center of a top end of the covering piece; and an resilient part integrally connected between the first end and the second end; the covering piece tended to return to its original position by the connector after opening it, thereby wearing securely, quickly reducing its volume, and compacting for easy storage.

9 Claims, 12 Drawing Sheets

DECORATIVE MASK

FIELD OF THE INVENTION

The present invention relates to a decorative mask used as face covering or decorating for ritual, ceremony and drama activities, especially in masquerade.

BACKGROUND OF THE INVENTION

People often dress up meticulously to enhance the activity of the atmosphere or attract other people's attraction at a festival, dance party, carnival, and birthday party, so ornate decorative masks often become an indispensable accessory on those occasions. The mask would have crown, combined with decorative piece or on the crown of feathers and other decorative materials, said mask and crown can combine integrally. For wearing securely, a belt or elastic band will be provided under the crown to fix under users chin or around their head. But there are few advantages for the mask used in belt or elastic band: (1) the people will sweat, if the mask wear for a long time due to the non-breathable band; (2) the modeling fixed to the crown cannot accommodate a variety of different head, therefore easy to be worn loose or that is too tight; (3) the crown is a three-dimensional configuration that cannot be compressed and stacked, thereby requiring more space for storage; (4) the crown is easy to be distorted caused by external force.

The inventor have developed two different decorative masks (U.S. Pat. Nos. 6,505,351; 6,604,975) which are used as headbands for its main body, the headband as the main body of the decorative mask can be wore on the head securely to prevent it from falling out and wear more easily, but there still have some disadvantages need to improve, for example, the structure of the headband cannot be folded, so it still needs more space for storage; besides, the distance between the mask and the headband is fixed, the mask cannot be adjustable depend on every users faces.

In view of this, the present invention is to develop a decorative mask capable of reducing its size to facilitate storage and easily putting it on.

SUMMARY OF INVENTION

The purpose of the present invention is to provide a decorative mask capable of reducing its size to facilitate storage, easily wearing, and avoiding gaps between the face and the mask.

To solve the above-mentioned problems and achieve the objectives of the present invention, the technical means is thus realized: a decorative mask, particularly the decorative mask used in a masquerade, comprising: an inverted U-shaped headband with resilient and holding function configured to wear around a user's head; a covering piece positioned on and connected with the headband by a connector, said covering piece defined as a mask; the connector including a first end arranged in one end thereof and connected in a center of a bottom end of the headband; a second end arranged in the other end thereof and connected in a center of a top end of the covering piece; and an resilient part integrally connected between the first end and the second end; the covering piece tended to return to its original position by the connector after opening it.

More particularly, wherein the connector is defined as a torsion spring, the first and second end defined as an arm and a retaining ring arranged at one end of the arm; the resilient part defined as a spiral spring ring; the headband and the covering piece corresponding to the first and second end respectively having two location holes; the headband and the covering piece being fixed by a rivet passing through the retaining rings of the first end and the second end, and then the two location holes.

More particularly, wherein the headband comprises a first notch disposed in a joint part between the headband and the first end of the connector; and first blocks respectively disposed in both ends of the first notch and configured to limit the displacement of the first end; the covering piece further comprising a second notch disposed in a joint part between the covering piece and the second end of the connector; and second blocks respectively disposed in both ends of the second notch and configured to limit the second end.

More particularly, wherein the connector is defined as an spring piece, the first end and second end defined as arc plates with buckle function, and the resilient part defined as a curved plate; the headband and the covering piece corresponding to the first end and second end respectively having two positioning holes which are the same rectangular ports disposed in parallel; the headband connected with the covering piece by passing through a front hole of the positioning holes with the first and second end, and then hooking a rear hole thereof to prevent the connector from movement.

More particularly, wherein the connector is defined as the torsion spring, the first and second end defined as the arm and square clamping springs respectively disposed in one end of the arm; the resilient part defined as the spiral spring ring; the headband and the covering piece corresponding to the first and second end respectively having two location holes, said two location holes defined as rectangular ports; the headband connected with the covering piece by inserting into the two location holes with two square damping springs, and then clamping the edge of the location holes to prevent the connector from movement.

More particularly, wherein the headband includes an erect decorative piece to decorate a top part of headband.

More particularly, wherein the decorative piece includes a plurality of coupling parts disposed at a bottom of an arc thereof, said coupling parts having ports; the headband having a plurality of through holes corresponding to the ports; the ports connected with the through holes via coupling elements.

More particularly, wherein the headband is provided with a vertical arch piece having a plurality of equidistant apertures; the decorative piece having a plurality of connecting holes corresponding to the apertures; the decorative piece coupling to the arch piece via a fixing part passing through the connecting hole and the aperture.

More particularly, wherein the headband have two protruding coupling pieces disposed in both bottom ends, said coupling pieces having joint holes; the coupling piece can connect with both sides of an annular elastic belt by passing through the joint holes with the fixing part, and then the covering piece can further fix the elastic belt at a bottom thereof by fixing part.

More particularly, wherein the elastic belt further includes a decoration which is fixed with elastic belt and the bottom of the covering piece by the fixing part.

Compared with the prior art, the present invention has the beneficial effects are that:

1. The connector can make the decorative mask to a nearly flat state, so it can quickly reduce the volume and compact for easy storage.

2. The covering piece can slightly touch the user's forehead and face by spring force to avoid gap between the face and the mask and wear securely.
3. The decorative mask is a simple structure, which is easy to make and spend less time to combine, so it can solve the problems about complicated making process and longer combining time in the prior art.
4. The first and second blocks limit the location of the connector to prevent the covering piece from moving from side to side, besides, the mask can maintain in the center of the forehead and face after wearing.

DETAILED DESCRIPTION OF THE PREFERRED EMBODIMENTS

Figure 1:
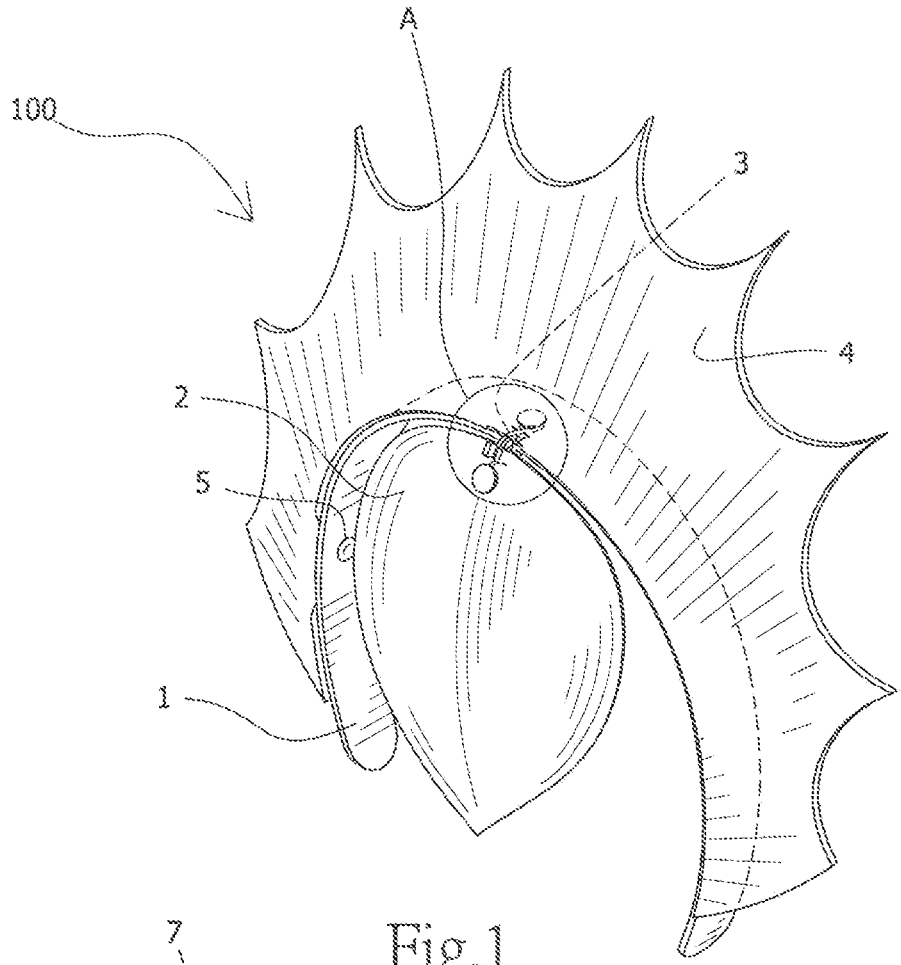
FIG. 1 is a perspective view of the present invention.
Figure 2:
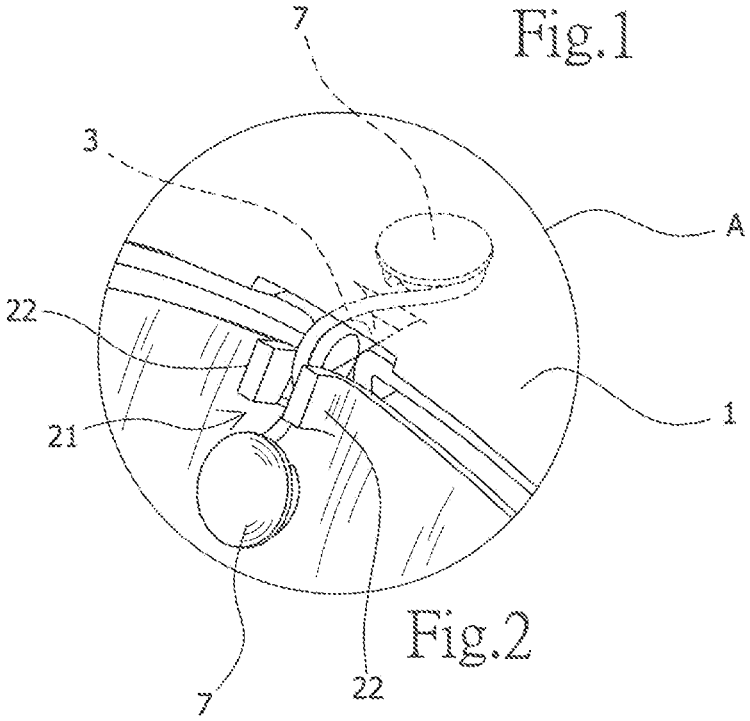
FIG. 2 is an enlarged view of portion A of FIG. 1.
Figure 3:
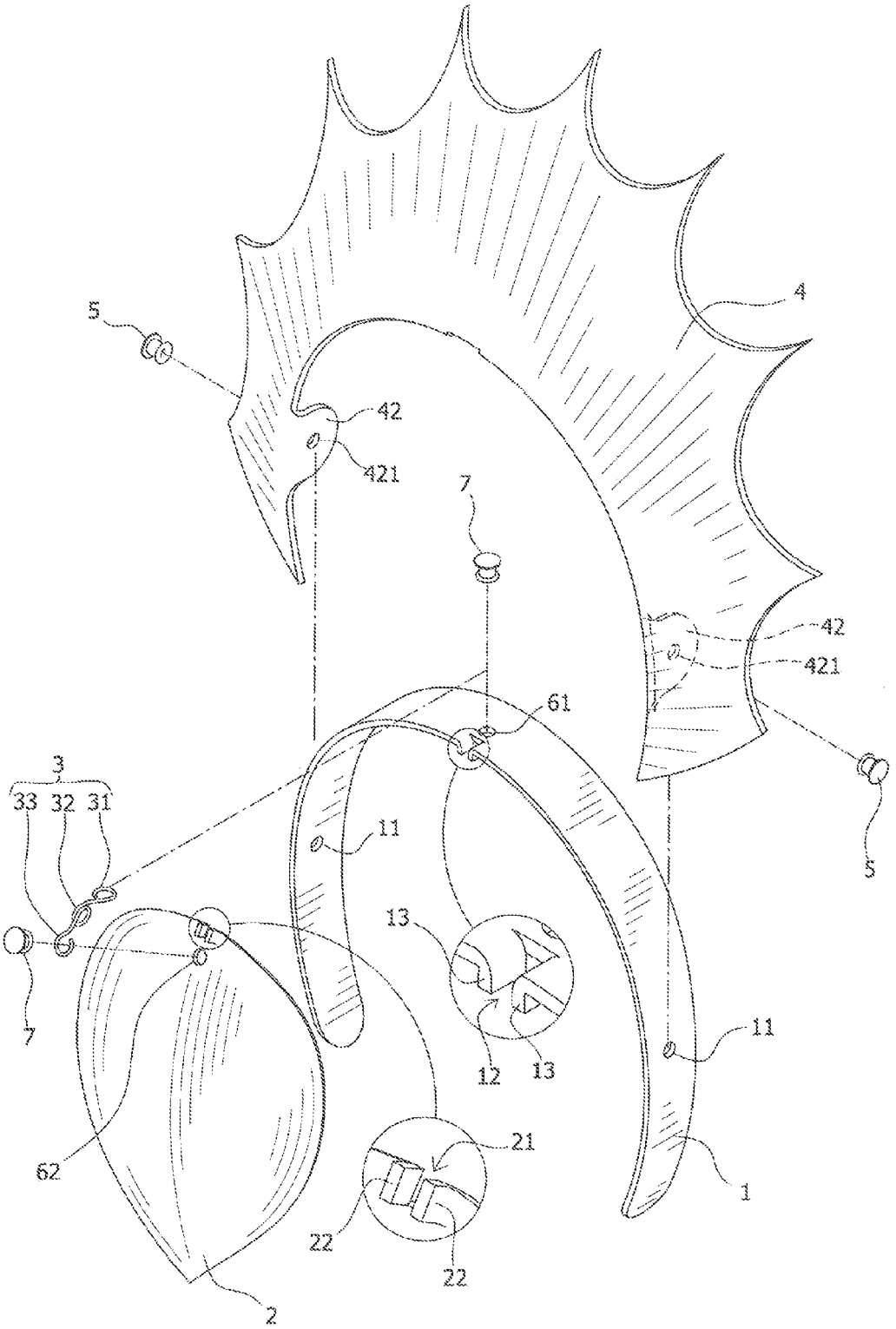
FIG. 3 is a perspective exploded view of FIG. 1.

With reference to FIGS. 1-3, and as previously described, the present invention discloses a decorative mask, particularly the decorative mask (100) used in a masquerade, comprising: an inverted U-shaped headband (1) with resilient and holding function configured to wear around a user's head; a covering piece (2) positioned on and connected with the headband (1) by a connector (3), said covering piece (2) defined as a mask; the connector (3) including a first end (31) arranged in one end thereof and connected in a center of a bottom end of the headband (1); a second end (33) arranged in the other end thereof and connected in a center of a top end of the covering piece (2); and an resilient part (32) integrally connected between the first end (31) and the second end (33); the covering piece (2) tended to return to its original position by the connector (3) after opening it.

Figure 16:
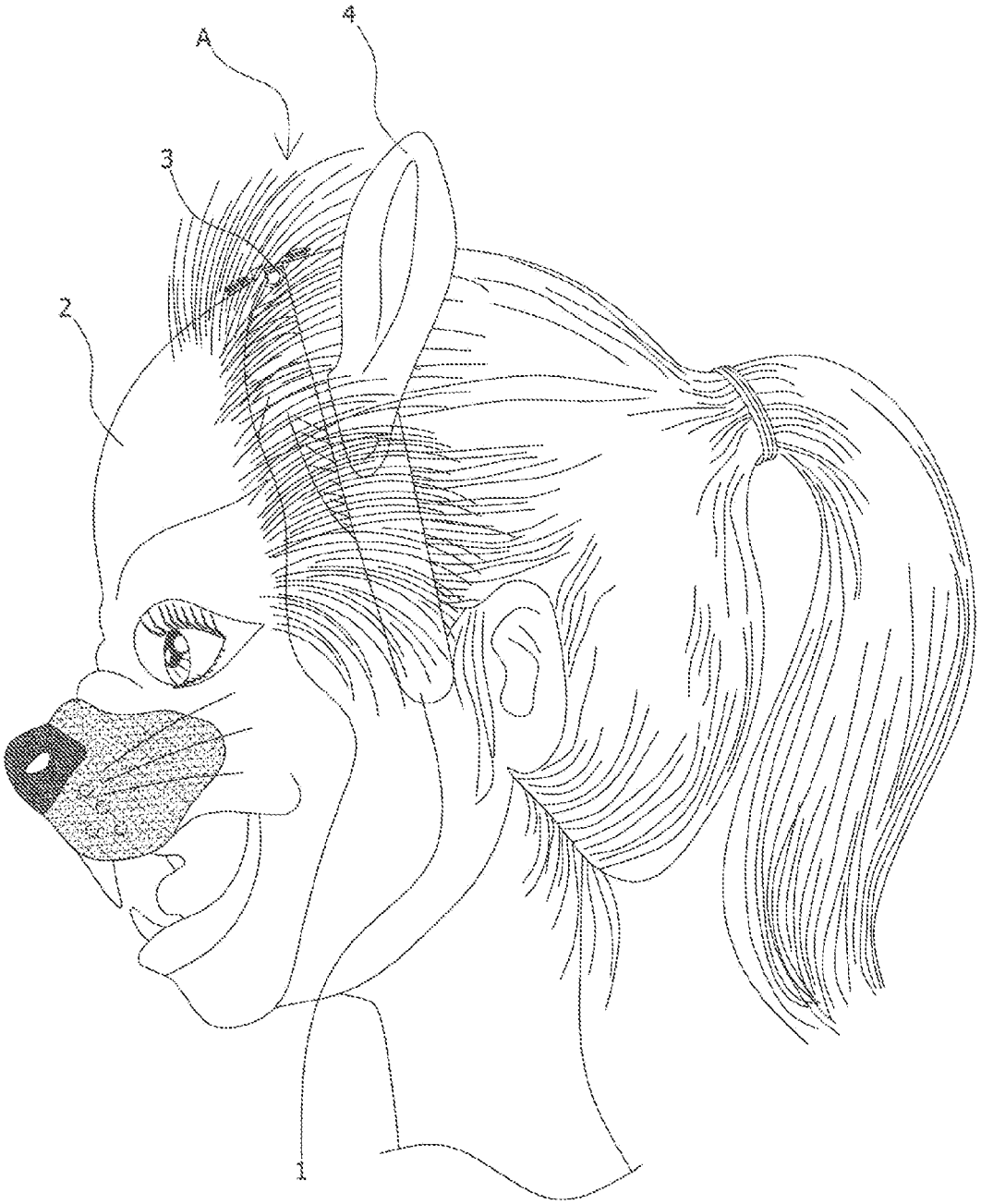
FIG. 16 is another implementation view of the present invention.

The headband is made of a plastic material, two sides of which can be extended outwardly by external force and backed to the original shape by its own plasticity. The covering piece (2) is an arc sheet made of plastic or presspaper, which can be used as a hood to cover use's forehead, and also can be various shapes to cover even the face, as shown in FIG. 16. The connector (13) is defined as a spring element which has different types, so the method of assembly between the headband (1) and the covering piece (2) will also vary. The following is to introduce different methods of assembly according to the type of the spring element.

Figure 4:
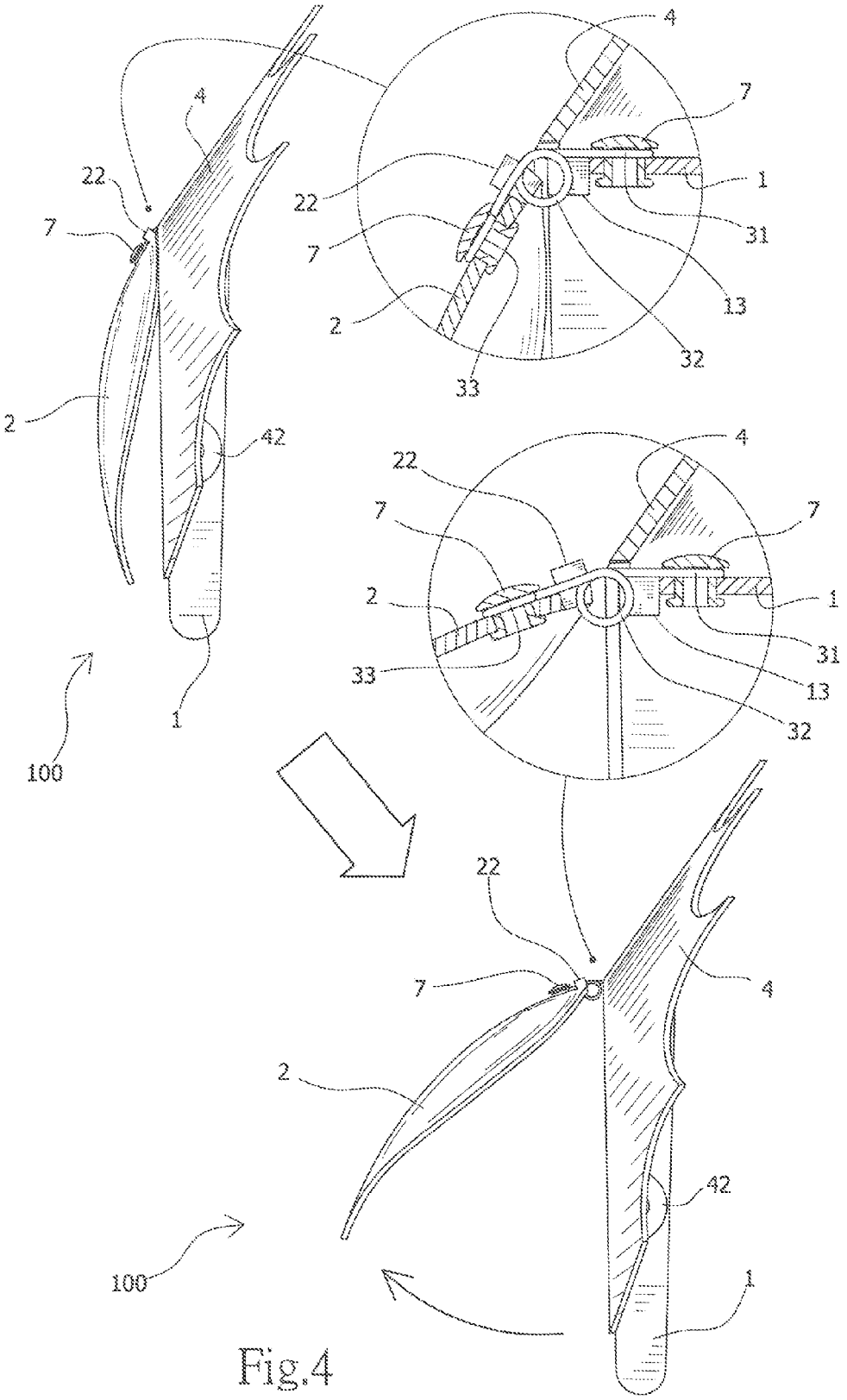
FIG. 4 illustrates a continuous motion schematic of a spring movable device of the present invention.
Figure 5:
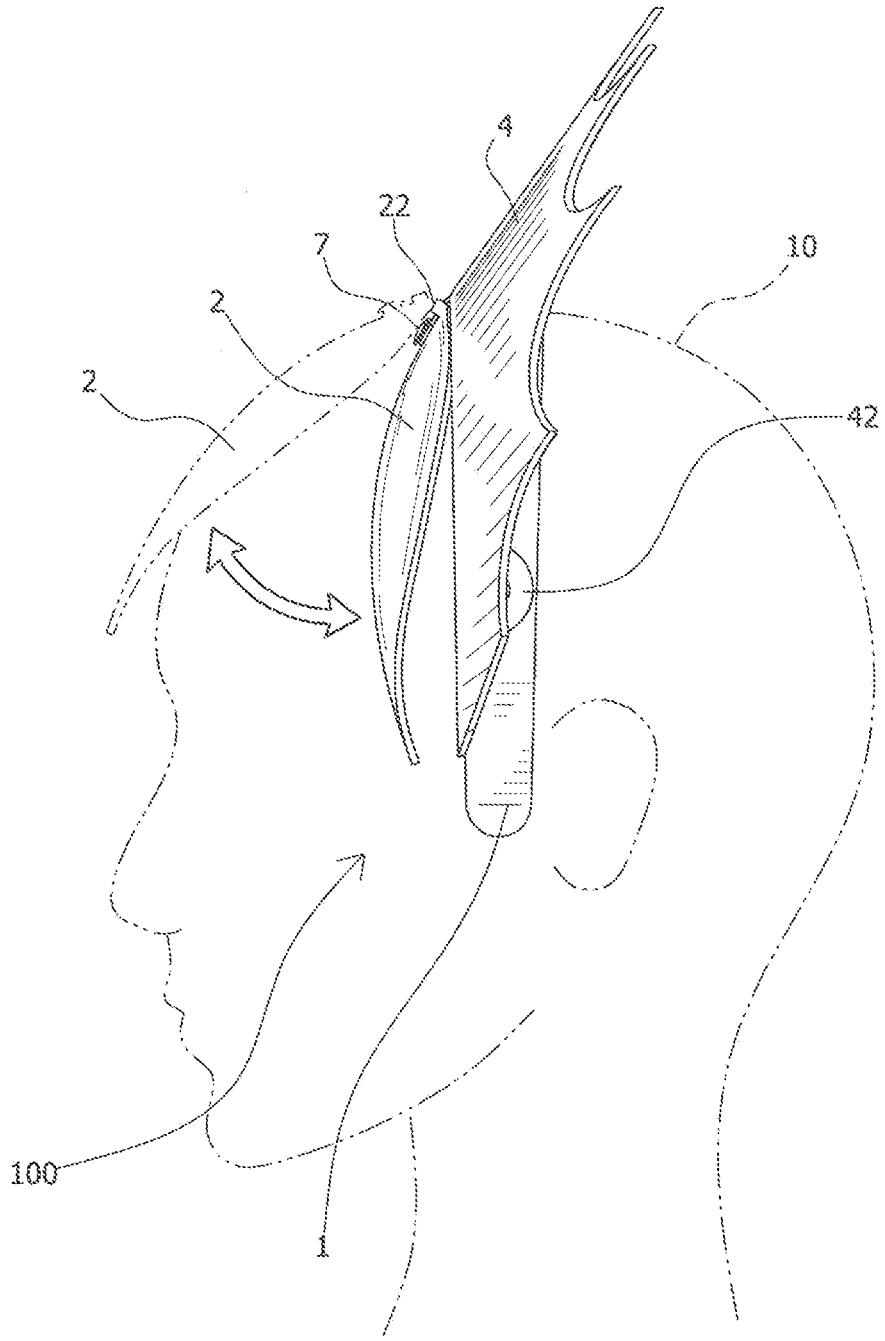
FIG. 5 is a perspective view of the present invention when wearing and not wearing.
Figure 6:
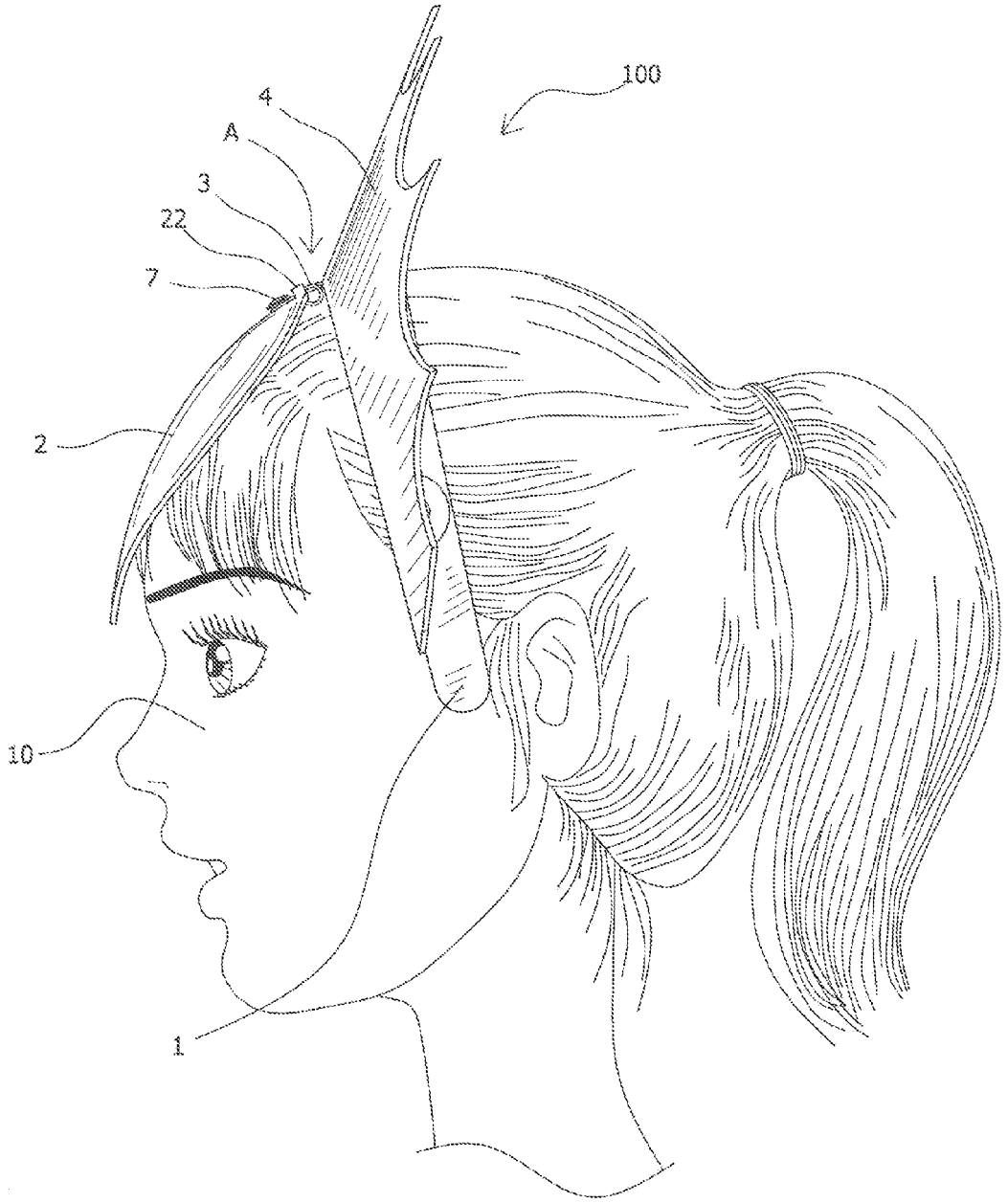
FIG. 6 is a state diagram when wearing on the decorative mask of the present invention.

Referring to FIG. 4-6, the present invention discloses the headband (1) wearing on the user's head (10) and connected with the covering piece (2) by the connector (3). With the spring force of the connector (3), the covering piece (2) can be opened up with external force and tend to return to its original position. Thus, the covering piece (2) covers on and contacts with the user's forehead after opening it, and backs to its original position when taking the headband (1) off from the user's head (10). The covering piece (2) can close to the user's face to avoid gap therebetween when wearing on it. Furthermore, the decorative mask is configured in a flat state when the covering piece (2) returns to its original position, thereby quickly reducing the volume and compacting for easy storage.

Traditional decorative masks and prior art are still not disclosed that the connector (3) which is disposed a center part between the headband (1) and the covering piece (2) and configured as a main piece of coupling device, so the connector (3) is the characteristic of the present invention, which is called ⌈spring moveable device A⌋.

First embodiment is described below, referring to FIG. 3, the connector (3) of the spring moveable device A is defined as a torsion spring, the first and second end (31, 33) defined as an arm and a retaining ring arranged at one end of the arm; the resilient part (32) defined as a spiral spring ring; the headband (1) and the covering piece (2) corresponding to the first and second end (31, 32) respectively having two location holes (61, 62); the headband (1) and the covering piece (2) being fixed by a rivet (7) passing through the retaining rings of the first end (31) and the second end (32), and then the two location holes (61, 62).

When the connector (3) is rotating, it generates a side-to-side moving that will cause the covering piece (2) unable to cover the user's face precisely, so the present invention discloses a ⌈limiting structure⌋ to solve the above mentioned problem, the technical scheme is as follows.

Wherein the headband (1) comprises a first notch (12) disposed in a joint part between the headband (1) and the first end (31) of the connector (3); and first blocks (13) respectively disposed in both ends of the first notch (12) and configured to limit the displacement of the first end (31); the covering piece (2) further comprising a second notch (21) disposed in a joint part between the covering piece (2) and the second end (33) of the connector (3); and second blocks (22) respectively disposed in both ends of the second notch (12) and configured to limit the second end (33). Referring to FIG. 2, the first and second notch (12, 21) receive and limit the arm of the first and second blocks (31, 33) to avoid displacement, thereby increasing the stability of the cover piece (2) open and close, but also can guarantee covering on the user's face precisely.

The limiting structure has two embodiments, the first embodiment as shown in FIGS. 2 and 3 discloses the first and second notch (12, 21) respectively disposed in a side edge of the headband (1) and the covering piece (2), which between them the first and second blocks (13, 22) are formed; the first and second blocks (13, 22) are a pair of protruding bumps that are perpendicular to the headband (1) and the covering piece (2), thereby limiting the first and second (31, 33) arranged therebetween.

Figure 9:
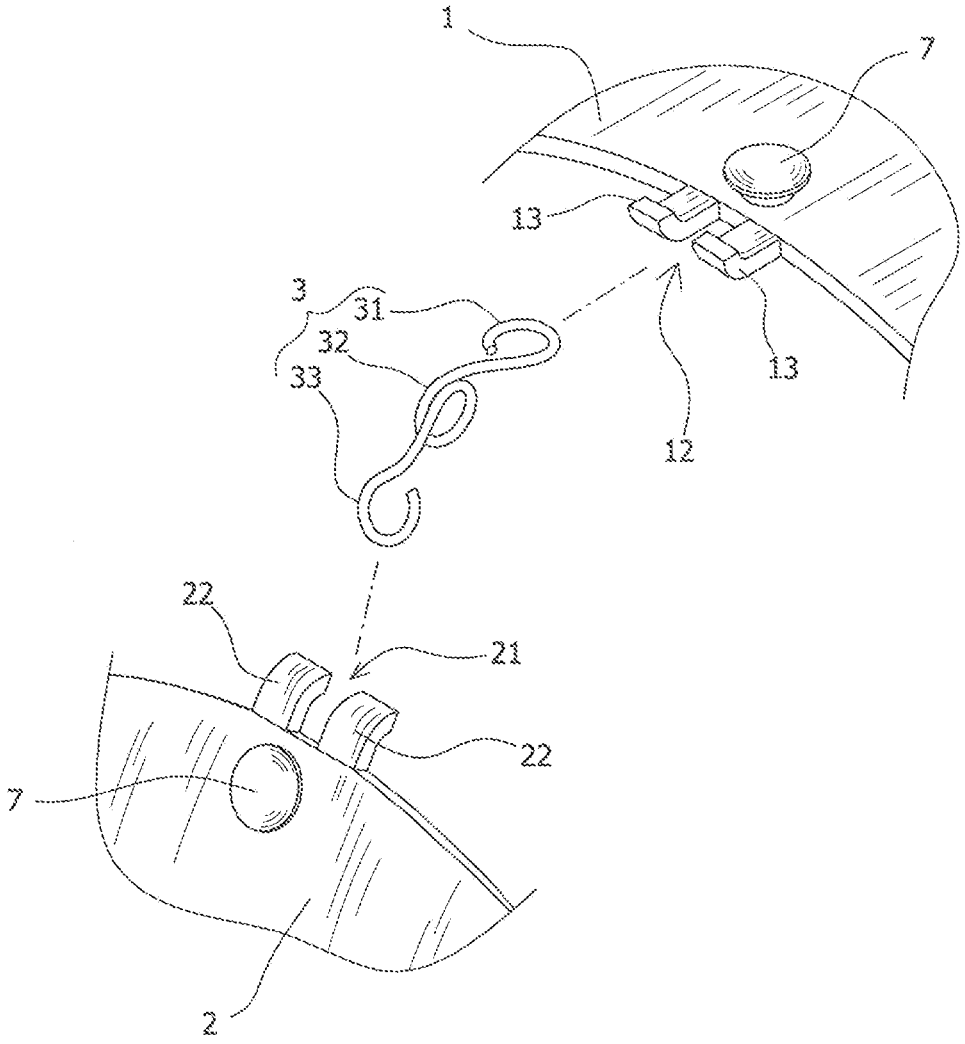
FIG. 9 is another limiting configuration of the present invention.

The second embodiment as shown in FIG. 9 discloses the first and second blocks (13, 22) symmetrically disposed and respectively protruded from the side edge of the headband (1) and the covering piece (2), and thus forming the first and second notch (12, 21) therebetweeen; the first and second blocks (13, 22) are configured in a L-shape, and both protruding parts of which are faced outwardly with each other to prevent interlacing.

Figure 10:
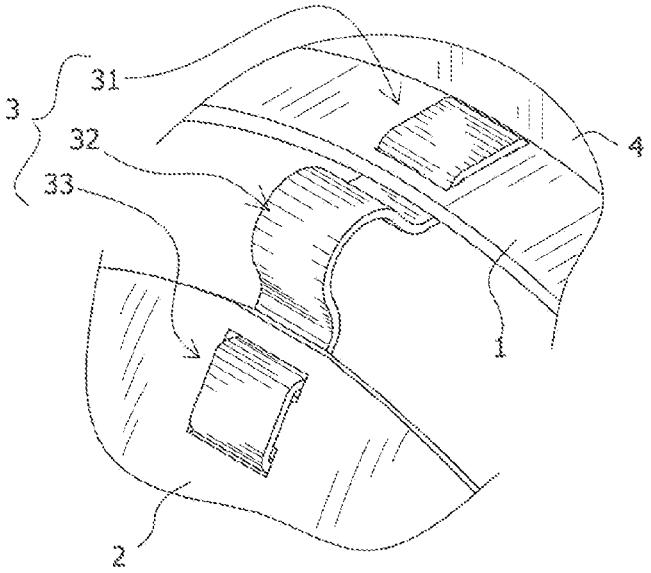
FIG. 10 is a perspective view of the spring movable device of the second embodiment in the present invention.
Figure 11:
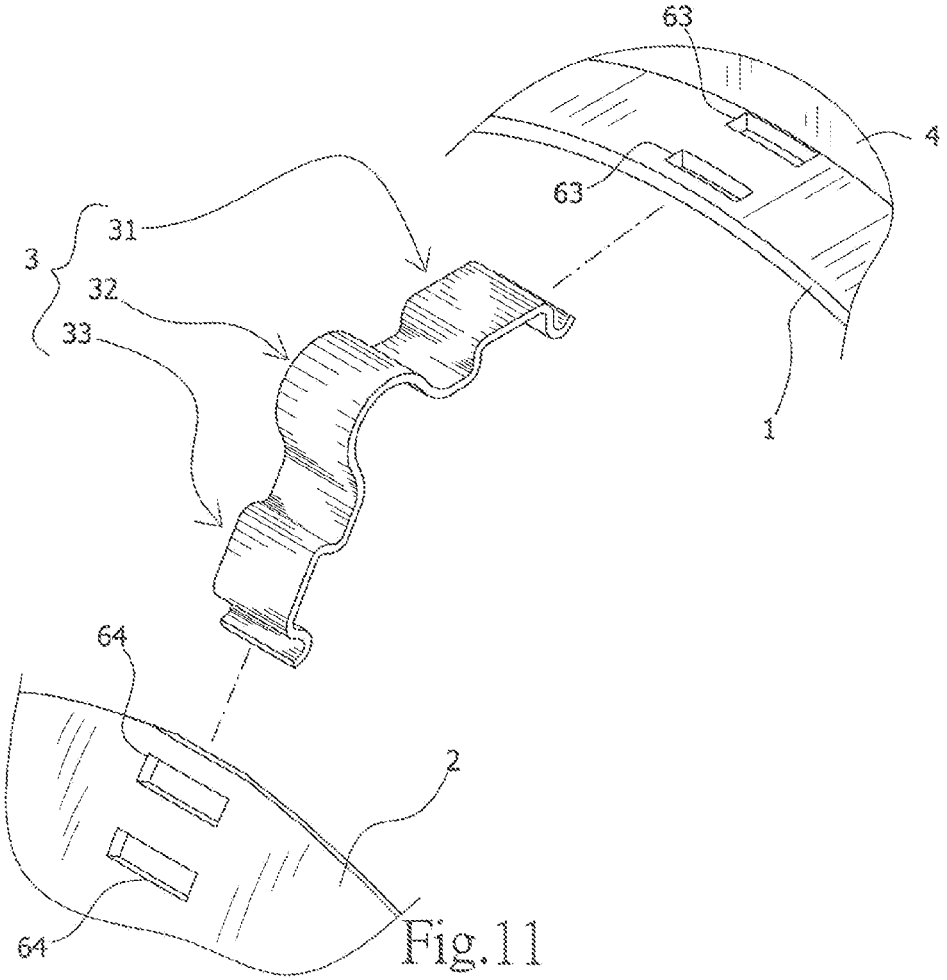
FIG. 11 is a perspective exploded view of FIG. 10.

The following describes the second embodiment of the spring movable device A, referring to FIG. 10 and 11, the connector (3) of the spring movable device A is defined as an spring piece, the first end and second end (32,31) defined as arc plates with buckle function, and the resilient part (32) defined as a curved plate; the headband (1) and the covering piece (2) corresponding to the first end and second end (32,31) respectively having two positioning holes (63, 64) which are the same rectangular ports disposed in parallel; the headband (1) connected with the covering piece (2) by passing through a front hole of the positioning holes (63, 64) with the first and second end (31,33), and then hooking a rear hole thereof to prevent the connector (3) from movement.

Figure 12:
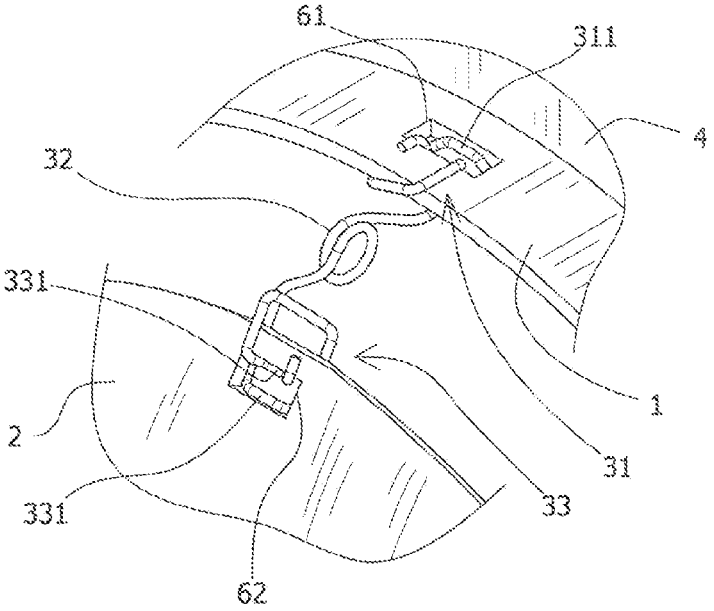
FIG. 12 is a perspective view of the spring movable device of the third embodiment in the present invention.
Figure 13:
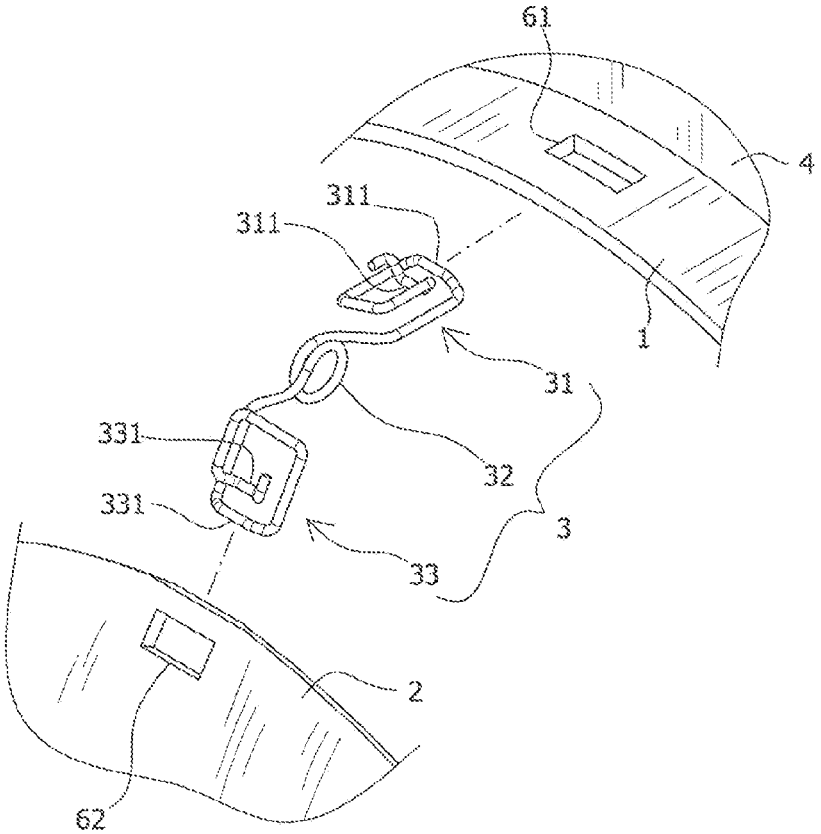
FIG. 13 is a perspective exploded view of FIG. 12.

The following describes the second embodiment of the spring movable device A, referring to FIG. 12, 13, the connector (3) of the spring movable device A is defined as the torsion spring, the first and second end (31, 33) defined as the arm and square clamping springs (311,331) respectively disposed in one end of the arm; the resilient part (32) defined as the spiral spring ring; the headband (1) and the covering piece (2) corresponding to the first and second end (31, 32) respectively having two location holes (61, 62), said two location holes defined as rectangular ports; the headband (1) connected with the covering piece (2) by inserting into the two location holes (61, 62) with two square clamping springs (311,331), and then damping the edge of the location holes to prevent the connector (3) from movement.

In order to increase the gorgeous effect, the headband (1) combines a variety of decorative pieces, which has two embodiments of combination, the first embodiment as shown in FIG. 3 discloses the headband (1) includes an erect decorative piece (4) to decorate a top part of headband (1); wherein the decorative piece (4) includes a plurality of coupling parts (42) disposed at a bottom of an arc thereof, said coupling parts (42) having ports (421); the headband (1) having a plurality of through holes (11) corresponding to the ports (421); the ports (421) connected with the through holes (11) via coupling elements (5).

Figure 7:
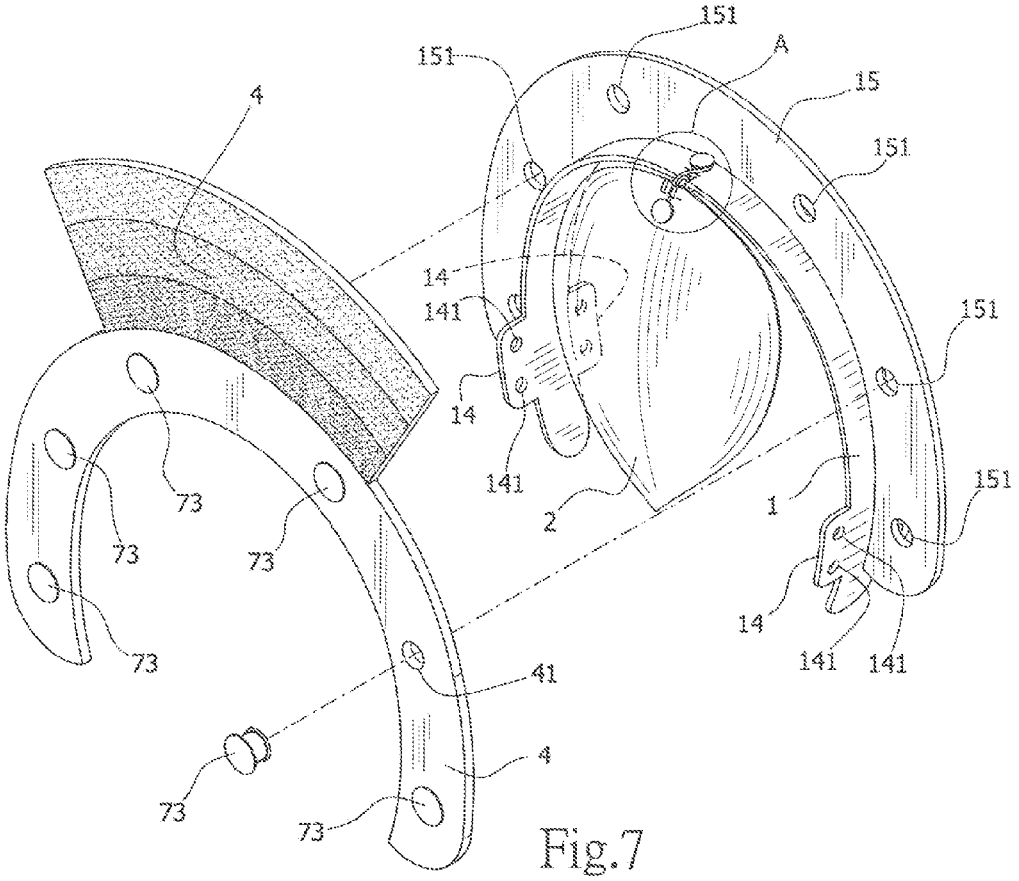
FIG. 7 is a perspective exploded view of another embodiment.
Figure 8:
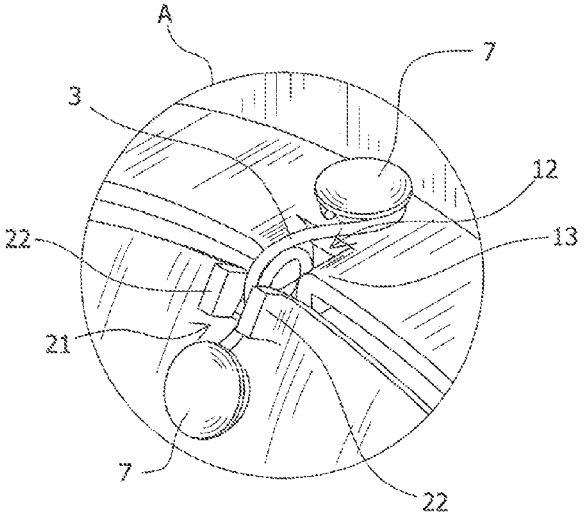
FIG. 8 is an enlarged view of portion A of FIG. 7.

The second embodiment of combination as shown in FIG. 7 discloses the headband (1) is provided with a vertical arch piece (15) having a plurality of equidistant apertures (151); the decorative piece (4) having a plurality of connecting holes (41) corresponding to the apertures (151); the decorative piece (4) coupling to the arch piece (15) via a fixing part (73) passing through the connecting hole (41) and the aperture (151). The arch piece can be made integrally with or by hot melt adhesive on the headband (1).

Figure 14:
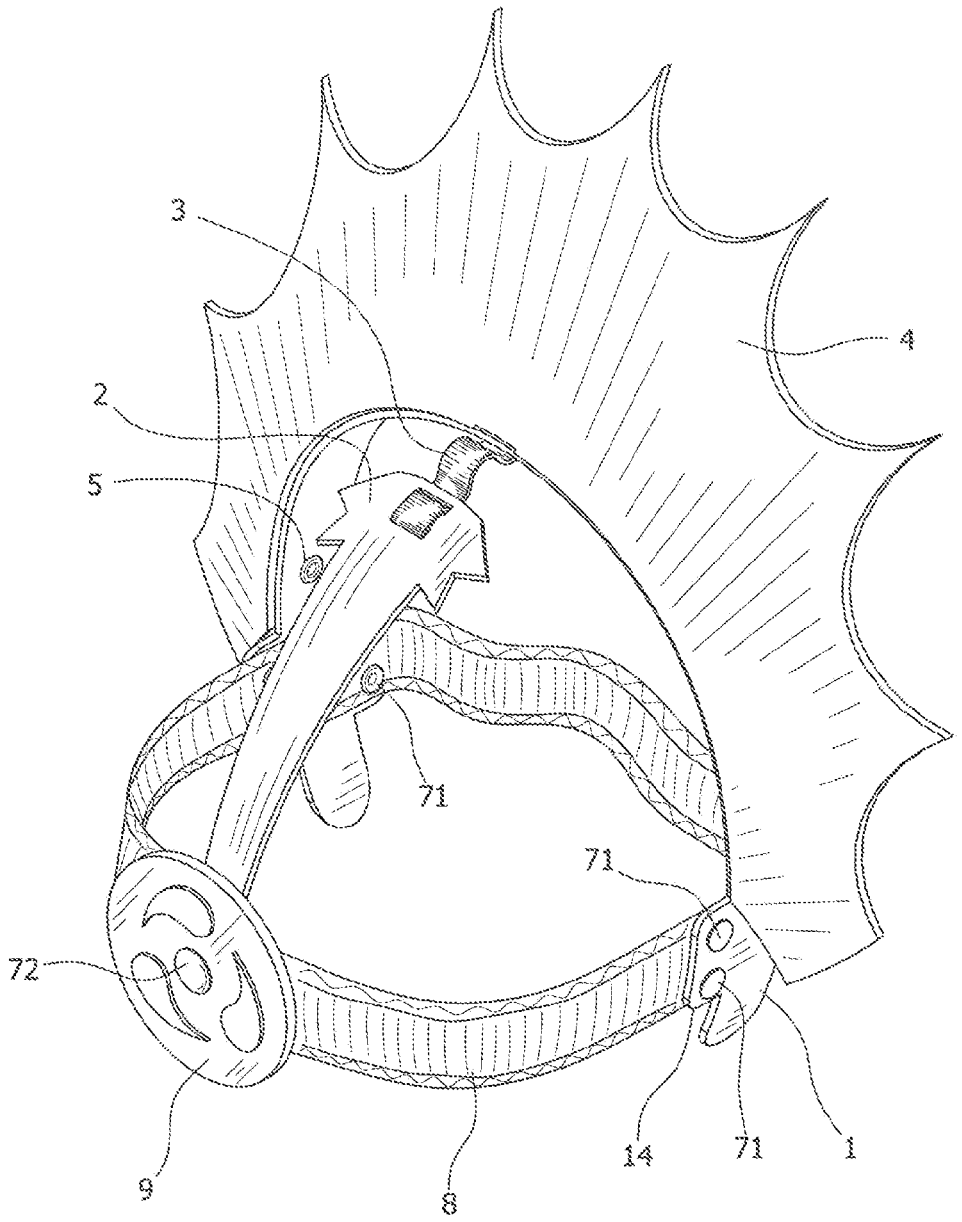
FIG. 14 is a perspective view combined with an elastic belt.

Besides, FIGS. 7 and 14 further disclose the headband (1) have two protruding coupling pieces (14) disposed in both bottom ends, said coupling pieces having joint holes (141); the coupling piece (14) can connect with both sides of an annular elastic belt (8) by passing through the joint holes (141) with the fixing part (71), and then the covering piece (2) can further fix the elastic belt (8) at a bottom thereof by fixing part (72).

Figure 15:
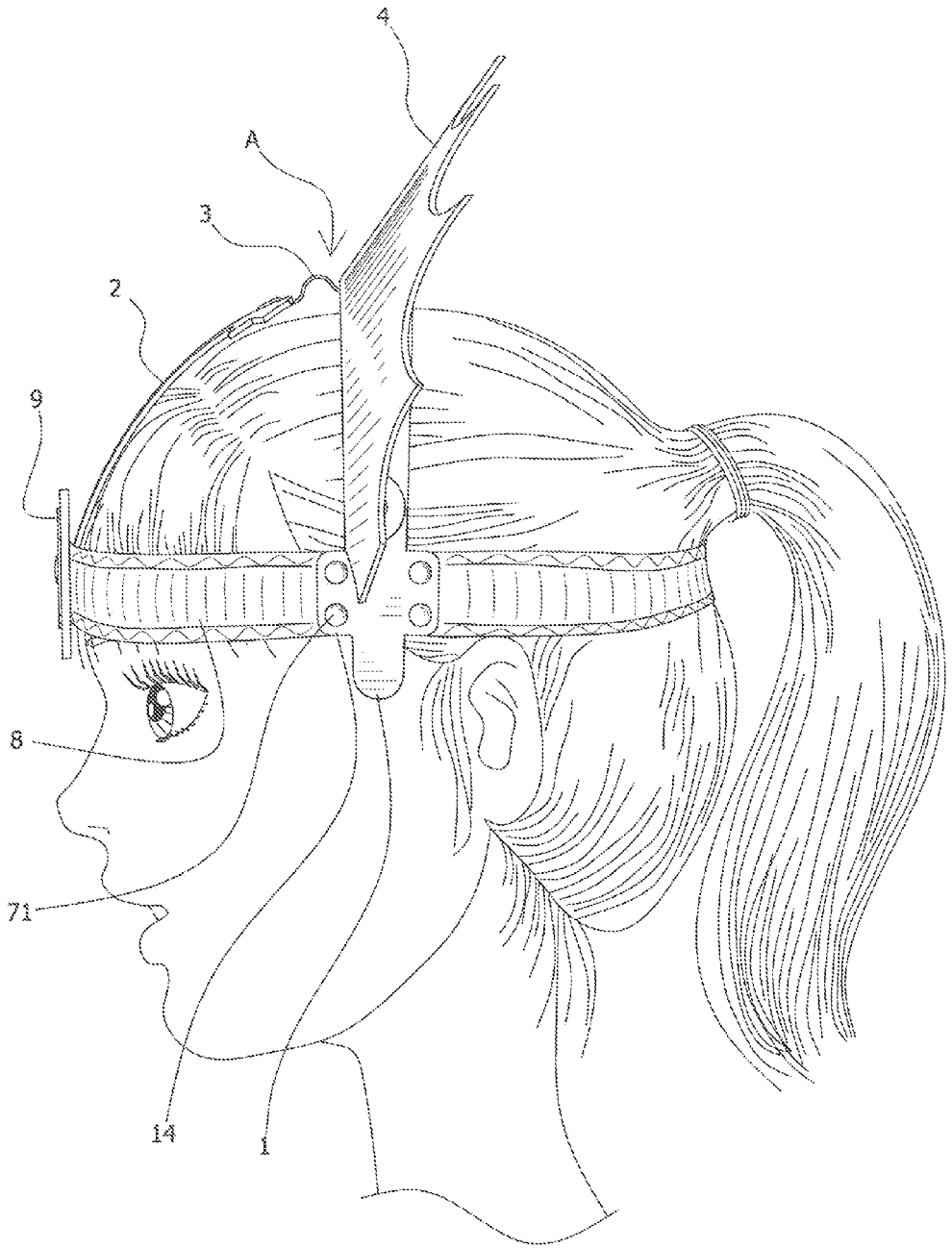
FIG. 15 is an implementation view of FIG. 14.

Furthermore, the FIGS. 14 and 15 disclose the elastic belt (8) further includes a decoration (9) which is fixed with elastic belt (8) and the bottom of the covering piece (2) by the fixing part (72). Regardless of the size, shape, color, and material of the decoration (9), it is mainly used as decoration in front of head. The elastic belt is configured to increase stability of wearing.

The above mentioned fix elements (7, 71, 72, 73) can be used by a rivet, a screw and other hardware components, or with hot melt adhesive, glue adhesive to implement, as there are many variants, collectively referred to as fixing parts, which are to be included within the scope of the present invention regardless of any forms.

At last, FIG. 16 discloses the covering piece is a mask that is covered on and contacted with the user's face to avoid a gap therebetween, thereby increasing the stability of wearing.

It will be evident to those skilled in the art that the invention is not limited to the details of the foregoing illustrated embodiments and that the present invention may be embodied in other specific forms without departing from the spirit or essential attributes thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

I claim:

1. A decorative mask for use in a masquerade, comprising:

an inverted U-shaped headband (1) with resilient and holding function configured to wear around a user's head;

a covering piece (2) positioned on and connected with the headband (1) by a connector (3), said covering piece (2) defined as a mask;

the connector (3) including a first end (31) connected in a center of a bottom end of the headband (1); a second opposite end (33) connected in a center of a top end of the covering piece (2); and an resilient part (32) integrally connected between the first end (31) and the second opposite end (33); when the covering piece (2) is opened up by an external force, the covering piece is biased by the connector to a collapsed position;

wherein the connector (3) is defined as a torsion spring, and the first and second opposite ends (31, 33) are defined as arms with retaining rings at one end thereof; the resilient part (32) defined as a spiral spring ring; the headband (1) and the covering piece (2) corresponding to the first and second end (31, 32) respectively having two location holes (61, 62); the headband (1) and the covering piece (2) being fixed by a rivet (7) passing through the retaining rings of the first end (31) and the second end (32), and then the two location holes (61, 62).

2. The decorative mask according to claim 1, wherein the headband (1) comprises a first notch (12) disposed in a joint part between the headband (1) and the first end (31) of the connector (3); and first blocks (13) respectively disposed in both ends of the first notch (12) and configured to limit a displacement of the first end (31); the covering piece (2) further comprising a second notch (21) disposed in a joint part between the covering piece (2) and the second opposite end (33) of the connector (3); and second blocks (22) respectively disposed in both ends of the second notch (12) and configured to limit the second opposite end (33).

3. The decorative mask according to claim 1, wherein the connector (3) is defined as a spring piece, the first end and second end (32,31) defined as arc plates with buckle function, and the resilient part (32) defined as a curved plate; the headband (1) and the covering piece (2) corresponding to the first end and second end (32,31) respectively having two positioning holes (63, 64) which are rectangular ports disposed in parallel; the headband (1) connected with the covering piece (2) by passing through a front hole of the positioning holes (63, 64) with the first and second opposite end (31,33), and then hooking a rear hole thereof to prevent the connector (3) from movement.

4. The decorative mask according to claim 1, wherein the connector (3) is defined as a torsion spring, and the first and second opposite ends (31, 33) are defined as arms with square clamping springs (311,331) at one end thereof; the resilient part (32) defined as a spiral spring ring; the headband (1) and the covering piece (2) corresponding to the first and second end (31, 32) respectively having two location holes (61, 62), said two location holes defined as rectangular ports; the headband (1) connected with the covering piece (2) by inserting into the two location holes (61, 62) with two square clamping springs (311,331), and then clamping an edge of the location holes to prevent the connector (3) from movement.

5. The decorative mask according to claim 1, wherein the headband (1) includes an erect decorative piece (4) to decorate a top part of headband (1).

6. The decorative mask according to claim 5, wherein the decorative piece (4) includes a plurality of coupling parts (42) disposed at a bottom of an arc thereof, said coupling parts (42) having ports (421); the headband (1) having a plurality of through holes (11) corresponding to the ports (421); the ports (421) connected with the through holes (11) via coupling elements (5).

7. The decorative mask according to claim 5, wherein the headband (1) is provided with a vertical arch piece (15) having a plurality of first equidistant apertures (151) disposed thereon; the decorative piece (4) includes a plurality of second apertures (41) disposed thereon and corresponding to the plurality first apertures (151) of the arch piece (15); the decorative piece (4) is coupled to the arch piece (15) via fixing parts (73) passing through the plurality of second apertures (41) and the plurality of first apertures (151).

8. The decorative mask according to claim 1, wherein the headband (1) have two protruding coupling pieces (14) disposed in both bottom ends, said two coupling pieces having joint holes (141); the two coupling pieces (14) are connected to both sides of an annular elastic belt (8) by means of fixing parts (71) passing through the joint holes (141), and then a center bottom edge of the covering piece (2) is fixed to a front end of the elastic belt (8) by a connection part (72).

9. The decorative mask according to claim 8, wherein the elastic belt (8) further includes a decoration (9) which is fixed with elastic belt (8) and, a bottom of the covering piece (2) by the connection part (72).

* * * * *